US005557384A

United States Patent [19]

Takano et al.

[11] Patent Number: 5,557,384

[45] Date of Patent: Sep. 17, 1996

[54] IMAGE TRANSFERRING DEVICE FOR IMAGE FORMING EQUIPMENT

[75] Inventors: Satoshi Takano, Tokyo; Itaru Matsuda, Yokohama; Yuko Harasawa, Hayama-machi, all of Japan

[73] Assignee: Ricoh Company, Ltd., Tokyo, Japan

[21] Appl. No.: 325,078

[22] Filed: Oct. 19, 1994

Related U.S. Application Data

[63] Continuation-in-part of Ser. No. 6,521, Jan. 21, 1993.

[30] Foreign Application Priority Data

| | | | |
|---|---|---|---|
| Jan. 22, 1992 | [JP] | Japan | 4-9125 |
| Mar. 30, 1992 | [JP] | Japan | 4-74366 |
| Nov. 30, 1992 | [JP] | Japan | 4-320937 |
| Oct. 22, 1993 | [JP] | Japan | 5-265106 |

[51] Int. Cl.[6] ..... G03G 15/16

[52] U.S. Cl. ..... 355/274

[58] Field of Search ..... 355/271, 273, 355/274, 275; 430/126

[56] References Cited

U.S. PATENT DOCUMENTS

| | | |
|---|---|---|
| 3,647,292 | 3/1972 | Weikel, Jr. . |
| 3,830,589 | 8/1974 | Allen . |
| 3,832,053 | 8/1974 | Goel et al. . |
| 4,162,843 | 7/1979 | Inoue et al. . |
| 4,220,699 | 9/1980 | Ishida et al. . |
| 4,268,157 | 5/1981 | Ebi et al. . |
| 4,407,580 | 10/1983 | Hashimoto et al. . |
| 4,411,977 | 10/1983 | Tarumi et al. . |
| 5,138,363 | 8/1992 | Yuge . |
| 5,140,376 | 8/1992 | Gotoda et al. . |
| 5,148,224 | 9/1992 | Yamada et al. . |
| 5,153,653 | 10/1992 | Fuma et al. . |

(List continued on next page.)

FOREIGN PATENT DOCUMENTS

| | | |
|---|---|---|
| 0442527 | 8/1991 | European Pat. Off. . |
| 3908488 | 9/1989 | Germany . |
| 4040962 | 6/1991 | Germany . |
| 59-65866 | 4/1984 | Japan . |
| 1-292378 | 11/1989 | Japan . |
| 2-46477 | 2/1990 | Japan . |
| 3-167579 | 7/1991 | Japan . |
| 3-186876 | 8/1991 | Japan . |
| 3-231274 | 10/1991 | Japan . |
| 3-231783 | 10/1991 | Japan . |
| 4-121767 | 4/1992 | Japan . |

OTHER PUBLICATIONS

Patent Abstracts of Japan, vol. 5, No. 134 (P–077), Aug. 26, 1981, JP–A–56 069653, Jun. 11, 1981.

Patent Abstracts of Japan, vol. 15, No. 218 (P–1210), Jun. 4, 1991, JP–A–03 062077, Mar. 18, 1991.

Patent Abstracts of Japan, vol. 14, No. 332 (P–1077), Jul. 17, 1990, JP–A–02 110586, Apr. 23, 1990.

*Primary Examiner*—Robert Beatty

*Attorney, Agent, or Firm*—Oblon, Spivak, McClelland, Maier & Neustadt, P.C.

[57] ABSTRACT

An image transferring device incorporated in an image forming apparatus and capable of surely preventing a sheet from wrapping around a photoconductive element and from being incompletely separated from a transfer belt. A transfer bias and discharge are effected to prevent changes in the resistances of the transfer belt and sheet ascribable to changes in environment front translating into changes in a current to flow to the photoconductive element, and to efficiently dissipate a charge deposited on the belt. Various members constituting the device are positioned relative to one another such that the discharging effect is achievable most effectively while preventing the transfer bias from causing dielectric breakdown in any constituent part. A bias roller is held in contact with the transfer belt which is made of a dielectric material. A current $I_{OUT}$ to flow frown the bias roller to ground via a nip portion between the belt and an image carrier and the image carrier is maintained greater than or equal to a current $I_2$ to flow from the contact electrode to ground via the belt without the intermediary of the nip portion.

7 Claims, 15 Drawing Sheets

U.S. PATENT DOCUMENTS 5,172,173 12/1992 Goto et al. .
5,182,598 1/1993 Hara et al. .
5,198,863 3/1993 Goto et al. .
5,268,725 12/1993 Koga et al. .
5,291,253 3/1994 Kumasaka et al. ..... 355/275
5,300,984 4/1994 Fuma et al. ..... 355/275 X
5,386,274 1/1995 Sanpe et al. ..... 355/274 X

Fig. 15

| IMAGE \ $I_{OUT}/I_2$ | 0.1 | 0.5 | 0.8 | 1.0 | 1.5 | 2.0 |
|---|---|---|---|---|---|---|
| LOCAL OMISSION | × | × | △ | ○ | ○ | ○ |
| DISFIGUREMENT (LOW TEMPERATURE) | × | × | △ | ○ | ○ | ○ |

Fig. 16

| $L_3/L_2$ \ SURFACE RESISTANCE (Ω) | $10^6$ | $10^7$ | $10^8$ | $10^9$ |
|---|---|---|---|---|
| 1.0 | × | × | ○ | ○ |
| 2.0 | × | △ | ○ | ○ |
| 3.0 | × | ○ | ○ | ○ |

*Fig. 17*

($I_{OUT}$/(P×d) : UNIT : C/cm$^2$)

| $I_{OUT}$/(P×d) / IMAGE | $1\times10^{-8}$ | $2\times10^{-8}$ | $3\times10^{-8}$ | $4\times10^{-8}$ | $5\times10^{-8}$ | $6\times10^{-8}$ | $7\times10^{-8}$ | $8\times10^{-8}$ | $9\times10^{-8}$ | $10\times10^{-8}$ |
|---|---|---|---|---|---|---|---|---|---|---|
| LOCAL OMISSION | ○ | ○ | ○ | ○ | ○ | ○ | △ | △ | × | × |
| DISFIGUREMENT | × | △ | ○ | ○ | ○ | ○ | ○ | ○ | ○ | ○ |

IMAGE TRANSFERRING DEVICE FOR IMAGE FORMING EQUIPMENT

BACKGROUND OF THE INVENTION

The present invention is a continuation-in-part of copending U.S. application Ser. No. 08/006,521, filed Jan. 21, 1993.

The present invention relates to an image transferring device for a copier, printer or similar electrophotographic image forming equipment and, more particularly, to a positional relation between a transfer bias section and a discharge section with respect to a sheet and control over the transfer bias in an image transferring device of the type transferring an image from an image carrier to a transfer belt while transporting the sheet and causing it to electrostatically adhere to the belt.

It is a common practice with image forming equipment of the kind described to use either a corona discharge type image transferring device or a contact type image transferring device. The corona discharge type device transfers a toner image formed on a photoconductive element, or image carrier, to a sheet by effecting corona discharge at the rear of the sheet. The contact type device electrostatically transfers a toner image from a photoconductive element to a sheet carried on a transfer belt to which an electric field opposite in polarity to the toner image is applied. For example, Japanese Patent Laid-Open Publication No. 3-231276 discloses an image transferring device which transfers a toner image frown an image carrier to a sheet by effecting corona discharge at the rear of a transfer belt carrying the sheet thereon. As to image forming equipment of the type having an image carrier, a member for conveying a transfer medium, and an image transferring device for transferring a toner image from the image carrier to the medium by an electric field, Japanese Patent Laid-Open Publication No. 3-233485 defines a specific range of volume resistivity of the medium conveying member.

The contact type image transferring device usually includes an arrangement for applying a transfer bias to the transfer belt. For example, an electrode member is connected to a high-tension power source and held in contact with the rear of the belt at an image transfer position. Such an arrangement is advantageous over one using corona discharge, since it does not produce harmful ozone and can operate with a low voltage while reducing the size and cost of the device.

In addition to transferring a toner image from the photoconductive element to the sheet, the device with the above-stated bias arrangement deposits a polarized charge on the sheet by the transfer bias so as to cause the sheet to electrostatically adhere to the belt. Therefore, as the belt is moved, the sheet can be transported by the belt and separated from the belt due to the electrostatic adhesion.

However, when the sheet is caused to electrostatically adhere to the belt, it has lo be separated from the belt after image transfer. For the separation of the sheet, use may be made of a transfer belt having a resistance of $10^{10}$.Ω.cm to $10^{13}$.Ω.cm, and a discharge member located downstream of an image transfer position with respect to an intended direction of movement of the belt for dissipating the charge of the belt, as disclosed in Japanese Patent Laid-Open Publication No. 63-83762 by way of example. The discharge member reduces or cancels the charge of the sheet to promote easy separation of the sheet. Regarding the discharge of the belt, Japanese Patent Laid-Open Publication No. 53-96838, for example, teaches an arrangement which uses a transfer belt having a resistance of $10^8$ Ω.cm to $10^{13}$ Ω.cm and, in the event of continuously transferring images from a plurality of photoconductive elements to a sheet carried on the belt, dissipates a charge of the belt deposited by a discharge ascribable to the separation of the sheet from one photoconductive element before the belt faces the next element.

On the other hand, when the transfer bias is maintained constant, a current to flow to the photoconductive element changes relative to the bias set at the transfer belt side due to changes in temperature, humidity and other environmental conditions. For example, in a high temperature and high humidity environment, an excessive current is apt to flow to the photoconductive element since the belt and sheet absorb moisture to lower their resistances. This increases the charge deposited on the photoconductive element and often causes the sheet to wrap around the element. In the opposite environment, the transfer of a toner image becomes defective. In the light of this, use may be made of control circuitry having a controller for controlling the output current of a high-tension power source and to which a roller which supports the belt is connected, as taught in, for example, Japanese Patent Laid-Open Publication No. 231274/1991. The control circuitry detects the output current of the power source by the support roller via the belt and controls the output current in matching relation to a feedback current flowing through the support roller. With such control circuitry, it is possible to maintain the current to flow to the drum constant and thereby prevent the sheet from wrapping around the drum while eliminating defective image transfer.

However, simply selecting an electric characteristic with regard to the belt is not satisfactory when the transfer bias or the discharging operation is to be set as stated above. Particularly, it is necessary to eliminate the wrapping of the sheet, defective image transfer and incomplete sheet separation by adequately positioning the constituents of the image transfer device relative to each other and selecting adequate materials at the actual design stage. Moreover, for the control of the surface potential of the sheet via the belt, not only changes in environment but also other factors, e.g., changes in surface potential ascribable to changes in resistance which are in turn ascribable to irregularities in the quality of belts particular to the production line and the size of an image have to be taken into account. Should such changes be neglected, the amount of charge for setting up an electric field required for image transfer would change. This would not only degrade the quality of an image but also aggravate the defective sheet separation.

SUMMARY OF THE INVENTION

It is, therefore, an object of the present invention to provide an image transferring device for an image forming apparatus which surely prevents a sheet from wrapping around a photoconductive element and from being incompletely separated from a transfer belt.

In accordance with the present invention, a device for transferring an image formed on an image carrier to a sheet and then separating the sheet from the image carrier comprises a transfer belt made of a dielectric material and movable into contact with the outer periphery of the image carrier, a drive source for causing the transfer belt to rotate, a contact electrode held in direct contact with the transfer belt, and a charge source for applying a charge to the transfer belt via the contact electrode. A current flow from the contact electrode to ground via a nip portion between the transfer belt and the image carrier and the image carrier is maintained greater than or equal to a current flow from the contact electrode to ground via the transfer belt without the intermediary of the nip portion.

BRIEF DESCRIPTION OF THE DRAWINGS

The above and other objects, features and advantages of the present invention will become more apparent from the following detailed description taken with the accompanying drawings in which:

FIG. 15 is a table representing the results of experiments conducted to determine a relation between a ratio $I_{OUT}/I_2$ and an image;

FIG. 16 is a table indicating a range satisfying a relation $I_2 \leqq I_{OUT}$, as determined by changing the surface resistance of a portion of the transfer belt contacting the bias roller and the distance between the bias roller and the contact plate; and FIG. 17 is a table showing a relation between $I_{OUT}$(P·d) and the local omission of an image at an image transfer position due to discharge and the disfigurement of the same at a sheet separation position, which occur while $I_2 \geqq I_{OUT}$ holds.

DESCRIPTION OF THE PREFERRED EMBODIMENTS

Figure 1:
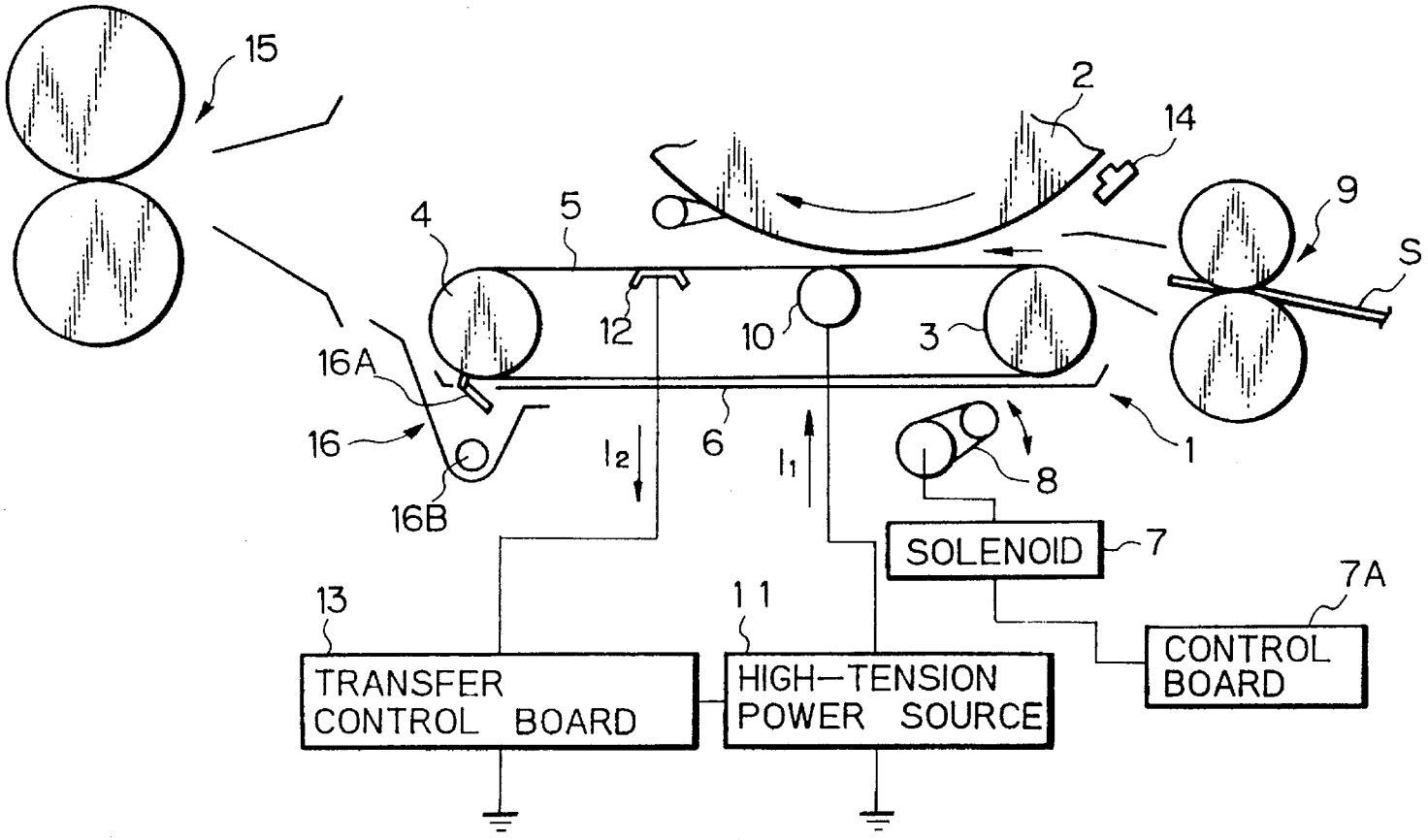
FIG. 1 is a section showing the general construction of an image transferring device embodying the present invention.
Figure 3:
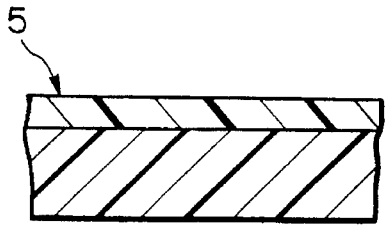
FIG. 3 is a section of a transfer belt included in the embodiment.

Referring to FIG. 1 of the drawings, an image transferring device for image forming equipment embodying the present invention is shown and generally designated by the reference numeral 1. As shown, the device 1 has a transfer belt 5 passed over a pair of rollers 3 and 4. An image is formed on a photoconductive drum 2 and transferred to a sheet S carried on the belt 5. Specifically, as the roller, or drive roller, 4 is rotated, the bell 5 is moved in a direction for transferring the sheet S (indicated by an arrow in the figure) at a position where it faces the drum 2. As shown in FIG. 3, the belt 5 has a double layer structure, i.e., an outer or surface layer and an inner layer. The surface layer has an electric resistance of $1\times10^9$ Ω to $1\times10^{12}$ Ω as measured at the surface of the belt 5. The inner layer has a surface resistivity of $8\times10^6$ Ω to $8\times10^8$ Ω and a volume resistivity of $5\times10^8$.Ω.cm to $5\times10^{10}$ Ω.cm.

The rollers 3 and 4 are rotatably supported by a support 6. The support 6 is angularly movable about a position where it supports the drive roller 4 which is located downstream of a transfer position with respect to the direction of sheet feed. A solenoid 7 is operated by a control board 7A to actuate the side of the support 6 adjoining the transfer position side of the belt 5. Specifically, a lever 8 is connected to the solenoid 7 to move the support 6 into and out of contact with the drum 2. Sheet transporting means in the form of a register roller 9 drives the sheet S toward the drum 2 in synchronism with an image formed on the drum 2. As the leading edge of the sheet S approaches the drum 2, the support 6 is moved toward the drum 2. As a result, the belt 5 is brought into contact with the drum 2 to form a nip portion B, FIG. 2, where it can transport the sheet S while urging the sheet S against the drum 2.

In the illustrative embodiment, the roller 3 closer to the drum 2 than the roller 4 is implemented as a driven roller made of rectal or similar conductive material having a relatively great electric capacity. The conductive driven roller 3 is held in a floating state to eliminate discharge ascribable to charge-up. In this configuration, charges deposited on the roller 3 are dissipated via the belt 5 having the above-stated electric characteristic. The surface of the roller 3 is tapered in the axial direction to prevent the belt 5 from becoming offset. The drive roller 4 is made of an insulating material in order to eliminate a sharp migration of charge which would cause a discharge to occur in the event of separation of the sheet S from the belt 5, as will be described specifically later. For example, the roller 4 is made of insulating EP rubber or chloroprene rubber for the above purpose and, at the same time, for enhancing the gripping force which the roller 4 exerts on the belt 5.

A bias roller 10 is located upstream of the drive roller 4 with respect to the moving direction of the belt 5 and held in contact with the inner surface of the belt 5. Connected to a high-tension power source 11, the bias roller 10 constitutes a contact electrode for applying to the belt 5 a charge which is opposite in polarity to a toner deposited on the drum 2. A contact plate 12 is positioned downstream of the bias roller 10 and in such a manner as to face the sheet S with the intermediary of one of opposite runs of the belt 5 corresponding to the sheet transport surface of the belt 5. The contact plate 12 detects a current flowing through the belt 5 as a feedback current. The current to be fed from the bias roller 10 is controlled in response to the output of the contact plate 12. A transfer control board 13 is connected to the contact plate 12 to set a current to be applied to the bias roller 10 on the basis of the detected current. The transfer control board 13 is also connected to the high-tension power source 11. After the transport operation, the sheet S is discharged as shown at 15.

Figure 2:
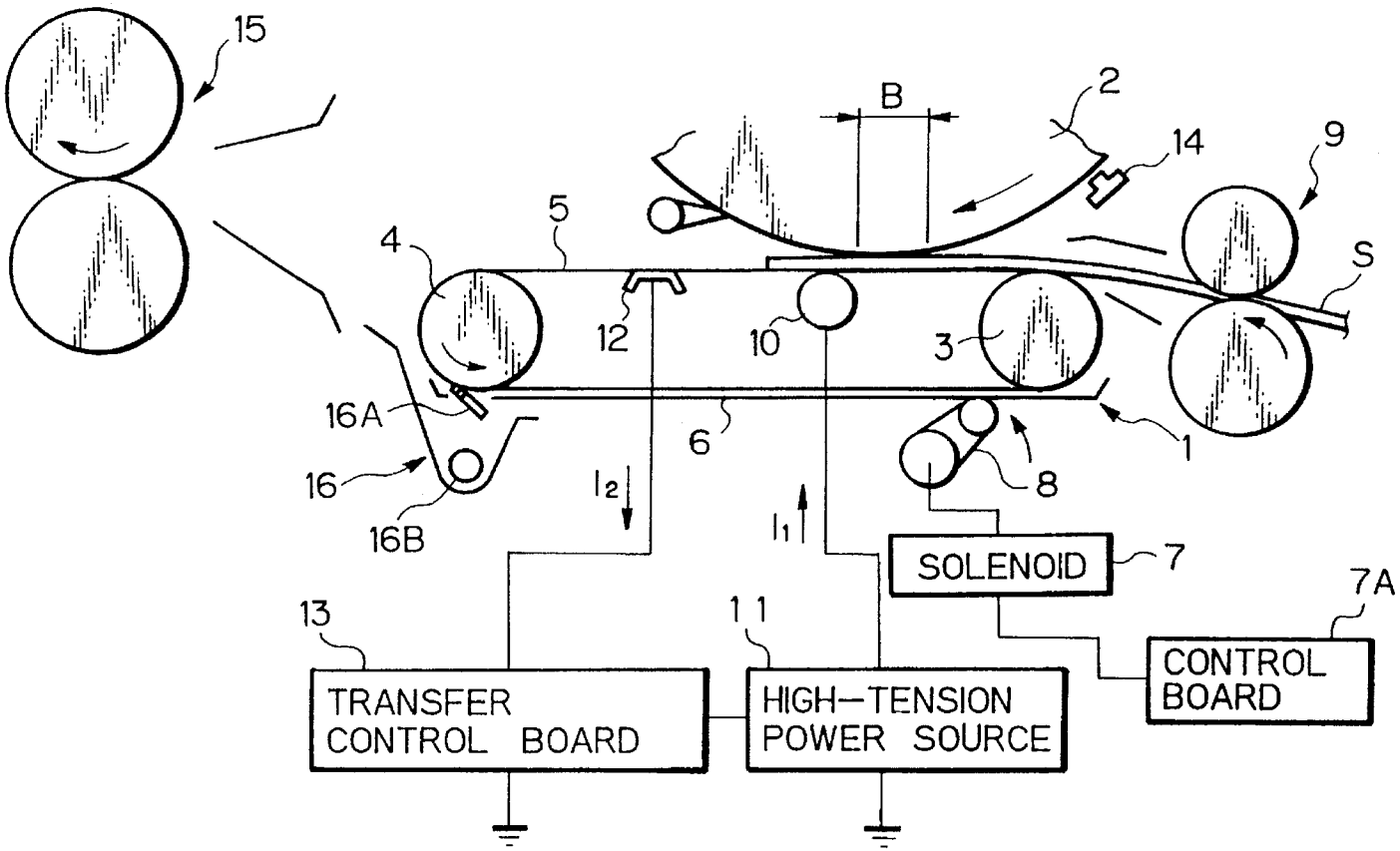
FIG. 2 demonstrates the operation of the embodiment for transferring an image.
Figure 4:
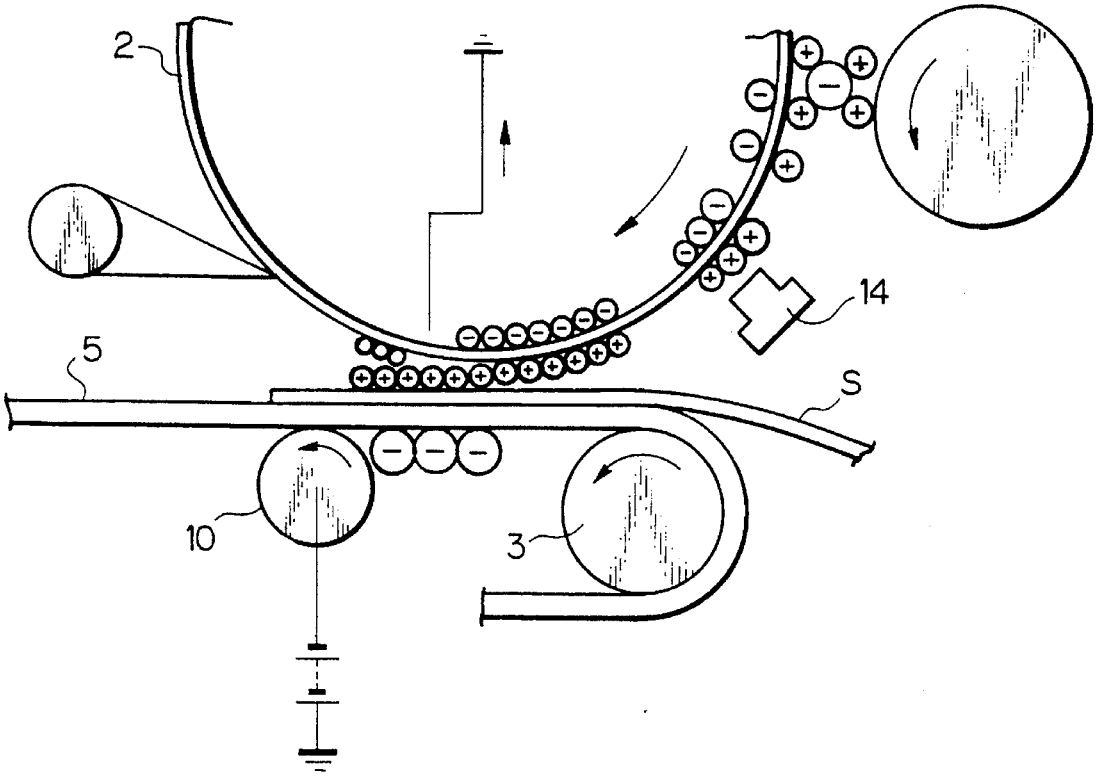
FIG. 4 is representative of a toner deposited on a photoconductive element included in the embodiment together with charges deposited on a sheet and the transfer belt for electrostatically transferring the toner.

In operation, as the sheet S is fed from the register roller 9, the support 6 and, therefore, the belt 5 is angularly moved toward the drum 2. Then, the bell 5 forms the nip portion B between it and the drum 2, as shown in FIG. 2. The nip portion B has a dimension of about 4 mm to about 8 mm in the direction of sheet transport. On the other hand, the drum 2 has the surface thereof charged to, for example, −800 V and electrostatically carries a toner thereon, as shown in FIG. 4. Before such a surface of the drum 2 reaches the nip portion B, the surface potential is lowered by a pretransfer discharge lamp 14. In FIG. 4, the size of a charge is represented by the diameter of a circle; charges lowered by the lamp 14 are represented by smaller circles. In the nip portion B, the toner on the drum 2 is transferred to the sheet S by the bias from the bias roller 10. In the embodiment, a voltage of '1.5 kV to −2.0 kV is applied to the bias roller 10, so that the potential of the belt 5 may range/tom −1.3 kV to −1.8 kV as measured in the nip portion 151.

The above-mentioned potential of the belt 5 in the nip portion B is selected for the following reason. In FIGS. 1 and 2, assume that the output current of the power source 11 is $I_1$, and that the feedback current flown from the contact plate 12 to ground via the belt 5 is $I_2$. Then, the current $I_1$ is controlled to satisfy an equation:

$$I_1 - I_2 = I_{OUT} \qquad \text{Eq. (1)}$$

where $I_{OUT}$ is constant. This is successful in stabilizing the surface potential $V_P$ of the sheet S and, therefore, in eliminating changes in transfer efficiency with no regard to temperature, humidity and other ambient conditions and irregularities in the quality of belts 5. More specifically, by considering that a current $I_{OUT}$ flows toward the drum 2 via the belt 5 and sheet S, it is possible to prevent the sheet separability and image transferability from being effected by changes in the easiness of current flow to the drum 2 which are ascribable to a decrease or an an increase in the surface potential $V_P$ of the sheet S.

As stated above, the potential of the belt 5 in the nip portion B is so set as to obtain the surface potential $V_P$ of the sheet S. In this connection, favorable image transfer was achieved when the $I_{OUT}$ was 35 μA plus 5 μA. It is to be noted that regarding the above-stated potential range of "−1.3 kV to −1.8 kV" of the belt 5, the surface potential of the sheet S may sometimes exceed the range, depending on the environment, the kind of sheet and/or the change in the resistance of the belt 5.

When an image is transferred from the drum 2 to the sheet S, the sheet S is also charged. Therefore, the sheet S can be electrostatically attracted onto the belt 5 and thereby separated from the drum 2 on the basis of the relation between the true charge on the belt 5 and the polarized charge on the sheet S. This is enhanced by the size of the transfer bias (higher than −3 kV) relative to the charge potential (−800 V) of the drum 2 and by, apart from the electrostatic relation, the elasticity of the sheet S using the curvature of the drum 2.

However, the electrostatic adhesion relying on a potential described above is not satisfactory since in a high humidity environment a current easily flows to the drum 2 to obstruct the separation of the sheet S. In the light of this, the surface layer of the bell 5, FIG. 2, is provided with a relatively high resistance so as to delay the shift of the true charge from the belt 5 to the sheet S in the nip portion B and, therefore, the flow of a current to the drum 2. In addition, the bias roller 10 is located downstream of the nip portion B in the direction of sheet transport. With this configuration, it is possible to eliminate the electrostatic adhesion of the sheet S and drum 2. To delay the shift of the true charge means to prevent a charge from depositing on the sheet S before the sheet S reaches the nip portion B. Hence, the sheet S is prevented from wrapping around the drum 2 or from being incompletely separated from the drum 2.

Also, the belt 5 should preferably be made of a material whose resistance is sparingly susceptible to changes in environment. For example, when the belt 5 is implemented as an elastic belt made of rubber, chloroprene or similar material having low hygroscopic property and stable resistance is more desirable than, for example, urethane rubber which is highly hygroscopic.

The current $I_{OUT}$ to flow to the drum 2 is not unconditionally selected. For example, the current $I_{OUT}$ may be reduced when the potential of the toner is low as in a digital system. Conversely, when the pretransfer discharge lamp is not used, the current $I_{OUT}$ may be increased in matching relation to an increase in the surface potential of the drum 2.

Experiments, conducted by changing the resistance of the belt 5, showed the following. As the surface resistance of the portion of the belt 5 contacting the bias roller 10 decreases, the voltage necessary for desirable image transfer and the irregular image transfer decrease. However, the decrease in the surface resistance of the above-mentioned portion of the belt 5 causes a current to flow through the belt 5 easily. In this condition, as the current $I_2$ which does not directly contribute to the image transfer increases, the discharge at the image transfer position and increases thereby causes an image to be locally lost on the sheet S. In addition, the disfigurement of the image is aggravated when the sheet S is separated from the belt 5, particularly when humidity is low. The image changes as shown in FIG. 15, depending on the ratio of the current $I_{OUT}$ to the current I2, i.e., $I_{OUT}/I_2$. For the experiments, the current $I_{OUT}$ and the linear velocity of the bell 5 were respectively selected to be 40 μA and 30 cm/sec. In FIG. 15, a desirable image, a slightly disfigured image and a noticeably disfigured image are respectively represented by a circle, a triangle, and a cross.

The results of experiments teach that the image suffers from a minimum of defect if $I_2 \leqq I_{OUT}$ is satisfied. Moreover, the current $I_{OUT}$ is the effective current necessary for image transfer, as also indicated by the results of experiments. Hence, assuming that $I_{OUT}$ is constant, $I_{OUT}/I_2$ greater than 1 desirably reduces the total current $I_1$ (= $I_{OUT}+I_2$) and, therefore, makes it needless to increase the capacity of the power source 11.

For $I_2 \leqq I_{OUT}$ to hold, the resistance of the belt 5 and the distance between the bias roller 10 and the contact plate 12 may be changed. The illustrative embodiment achieves a desirable image transfer and sheet separation ability with the dielectric belt 5 whose resistance satisfies $I_2 \leqq I_{OUT}$.

The sheet S passed the nip portion B is transported by the belt 5. During the transport, the electrostatic adhesion relation between the sheet S and the belt 5 is reduced or cancelled by the discharge effected by the contact plate 12. At this instant, the rate or speed at which the charge deposited on the sheet S is reduced is dependent on the resistance of the sheet S and the electrostatic capacity. Specifically, assuming that the resistance of the sheet is R and the electrostatic capacitance is C, the rate is expressed as:

$$\tau(\text{time constant}) = C \cdot R \qquad \text{Eq. (2)}$$

Hence, when the sheet S is implemented as an OHP sheet or has the resistance thereof increased due to high humidity, a substantial period of time is necessary for the charge deposited thereon to decrease. Such a sheet S is separated from the belt 5 by the curvature of the drive roller 4. For this purpose, the drive roller 4 is provided with a diameter less than 16 min. Experiments showed that when use was made of such a drive roller, a high quality 45K sheet (rigidity: horizontal 21 ($cm^3$/100)) could be separated. After the image transfer from the drum 2 to the sheet S and the separation of the sheet S, the solenoid 7 is deenergized to move the support 6 away from the drum 2. Then, the surface of the belt 5 is cleaned by a cleaning device 16 having a cleaning blade 16A. The cleaning blade 16A rubs the surface of the belt 5 to scrape off the toner transferred from the background of the drum 2 to the belt 5, the toner scattered around the belt 5 without being transferred, and paper dust separated from the sheet S. The belt 5 to be rubbed by the blade 16A is provided with a coefficient of friction low enough to eliminate an increase in required torque due to an increase in frictional resistance and to eliminate the deformation of the blade 16A. Specifically, in the embodiment, the surface of the blade 16A. Specifically, in fluorine (vinylidene polyfluoride). The toner and paper dust removed from the belt 5 by the blade 16A is collected in a waste toner container, not shown, by a coil 16B.

The various members for setting the surface potential of the sheet S as described above are related in position, as follows. To begin with, assuming that the current $I_{OUT}$ is constant, a change in the current $I_1$ to the bias roller 10 causes the output voltage $V_O$ of the power source 11 to change, as indicated by the Eq. (1). Assume that when the output voltage $V_O$ has a maximum value $V_{max}$, the distance from the driven roller 3 to the nip portion B is $L_1$ while the output voltage $V_O$ is applied to the bias roller 10. Then, the distance $L_1$ is so selected as to satisfy a relation:

$$L_1 \geqq a \times |V_O| \qquad \text{Eq. (3)}$$

where a is 1.0 (mm/kV). Further, assuming that the distance from the nip portion B to the bias roller 10 is $L_2$, then the distance $L_2$ is determined to satisfy a relation:

$$L_2 \geqq a \times |VO| \qquad \text{Eq. (4)}$$

where a is 1.0 (mm/kV) .

Why the distances $L_1$ and $L_2$ are selected as stated above is as follows. Assume that the bell 5 is a dielectric body having the time constant T. Then, as the bias roller 10 approaches the drum 2, e.g., reaches a position just below the drum 2 while the output voltage $V_O$ is high, dielectric breakdown is apt to occur in a conductor included in the drum 2. The distances $L_1$ and $L_2$ successfully eliminate such an occurrence.

Specifically, assuming that $L_1 = L_2 = 1$ mm and $V_O = -3$ kV, then a leak occurs from the bias roller 10 to the drum 2 over the gap. The leak occurs at, for example, micropores and comparatively thin portions which may exist in the belt 5. The leak breaks the portion where it occurred, i.e., it forms macropores in the surface of the belt 5 and that of the drum 2. As a result, power for forming an electric field for image transfer is not used and, therefore, the electric field is not formed, making the image transfer defective. Moreover, a spark discharge ascribable to the leak is not desirable from the safety standpoint. This is also true with the driven roller 3 held in a floating state.

For the reasons described above, the embodiment selects a $V_{max}$ of −3 kV and distances $L_1$ and $L_2$ of 8 mm and 6 mm, respectively. It is to be noted that the value a is variable in matching relation to the output voltage $V_O$ and may be 2 or greater than 2.

Assuming that the distance from the bias roller 10 to the contact plate 12 is $L_3$, then the distance $L_3$ is related to the distance $L_2$, as follows:

$$L_3 \geqq L_2$$

This is because, to achieve $I_{OUT}$ efficiently, the distance $L_3$, i.e., the resistance of the belt 5 per unit area should be great enough to distribute $I_1$ in a relation of $I_{OUT} > I_2$. Specifically, assuming that the feedback current $I_2$ is zero, i.e., the contact plate 12 is absent, $I_1$ will be equal to $I_{OUT}$, providing 100% efficiency. However, since the entire surface of the belt 5 will have exactly the same potential as the output voltage V(), electric noise will occur at the positions where the rollers contact the belt 5 and effect the control system to bring about errors.

Hence, a relation $I_1 = I_{OUT} + I_2$ is derived from the previously stated relation $I_1 - I_2 = I_{OUT}$.

It will be seen from the above that the power source current ($I_1$) is determined by the sum of $I_{OUT}$ and $I_2$ and, therefore, $I_2$ should be as small as possible in order to use the power source for the image transfer purpose as efficiently as possible. On the other hand, when the resistance of the belt 5 remains the same, the current distribution is inversely proportional to the distances $L_2$ and $L_3$. Therefore, a relation $L_3 \geqq L_2$ should hold as far as possible. When an experiment was conducted with a relation $L_3 > L_2$, the capacity of the power source and, therefore, the image transfer was found short. Further, since the power source is often built in a unit, the capacity thereof, i.e., the space for accommodating it cannot be increased beyond a certain limit. In this respect, too, the contact plate 12 for controlling the potential of the belt 5 and the abovementioned positional relation are indispensable.

Figure 5:
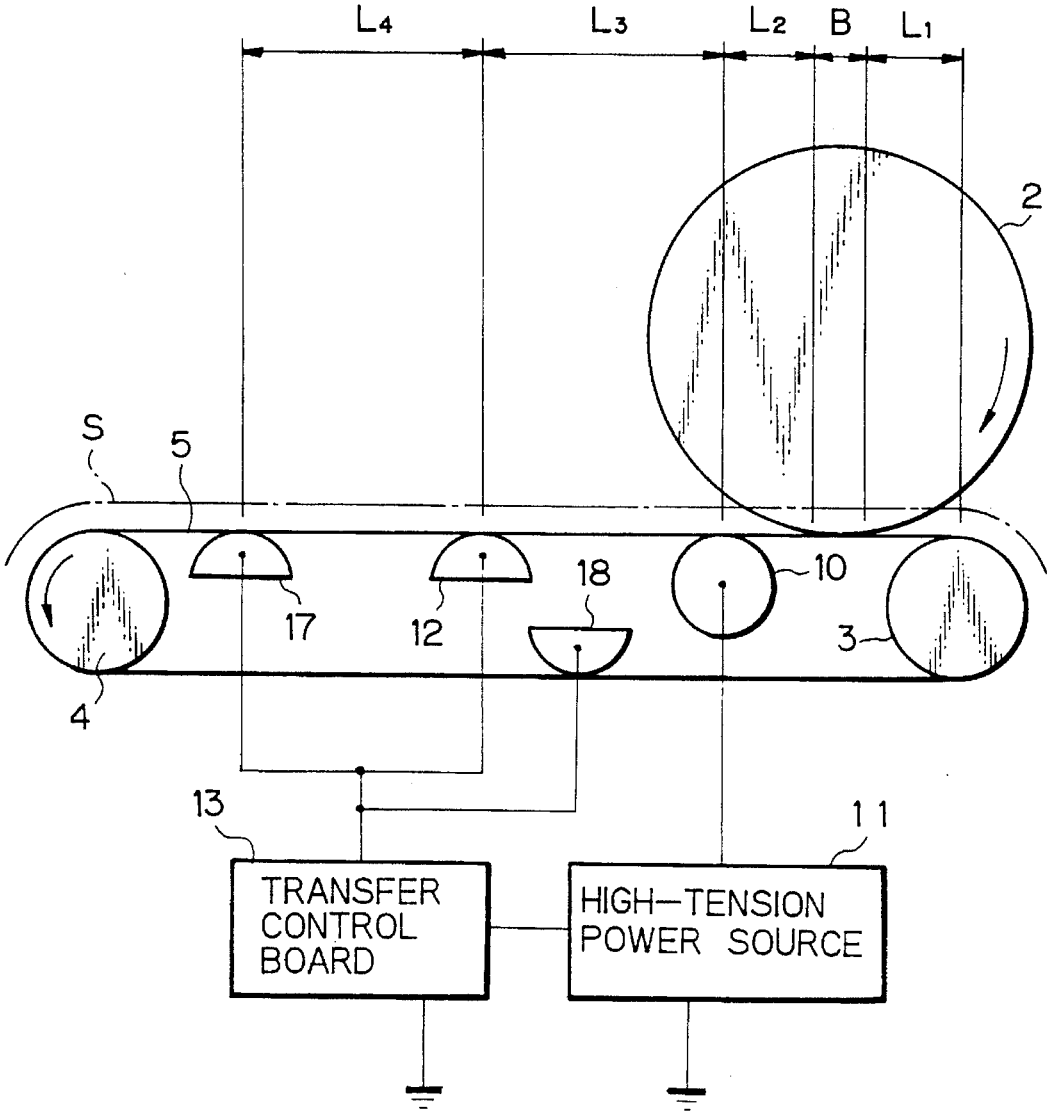
FIG. 5 is indicative of a positional relation of a driven roller, a bias roller and contact plates included in the embodiment.

As shown in FIG. 5, a second contact plate 17 may be located downstream of the contact plate 12 in the direction of sheet transport. In such a case, the contact plates 12 and 17 are spaced apart by a distance $L_4$ which insures the discharge of the belt 5 having the time constant $\tau = C \cdot R$. The distance $L_4$ depends on the process speed v of the belt 5 and is selected to satisfy a relation:

$$\tau \leqq L_4 / v$$

In this case, T indicates a period of time necessary for the belt 5 to be discharged, as counted from the time when the belt 5 has moved away from the first contact plate 12.

Specifically, considering the separation of the sheet from the belt 5, it is necessary to surely discharge the belt 5. When the belt 5 moved away from the second contact plate 17 is not fully discharged, the discharge of the belt 5 over the distance from the contact plate 17 and the separation position solely depends on the time constant of the belt 5. Therefore, only if the discharge depending on the time constant of the belt 5 is completed when the belt 5 has moved away from the contact plate 17, the belt 5 will be fully discharged. Such a relation is also desirable when the linear velocity (process speed) of the belt 5 is taken into account.

Figure 6:
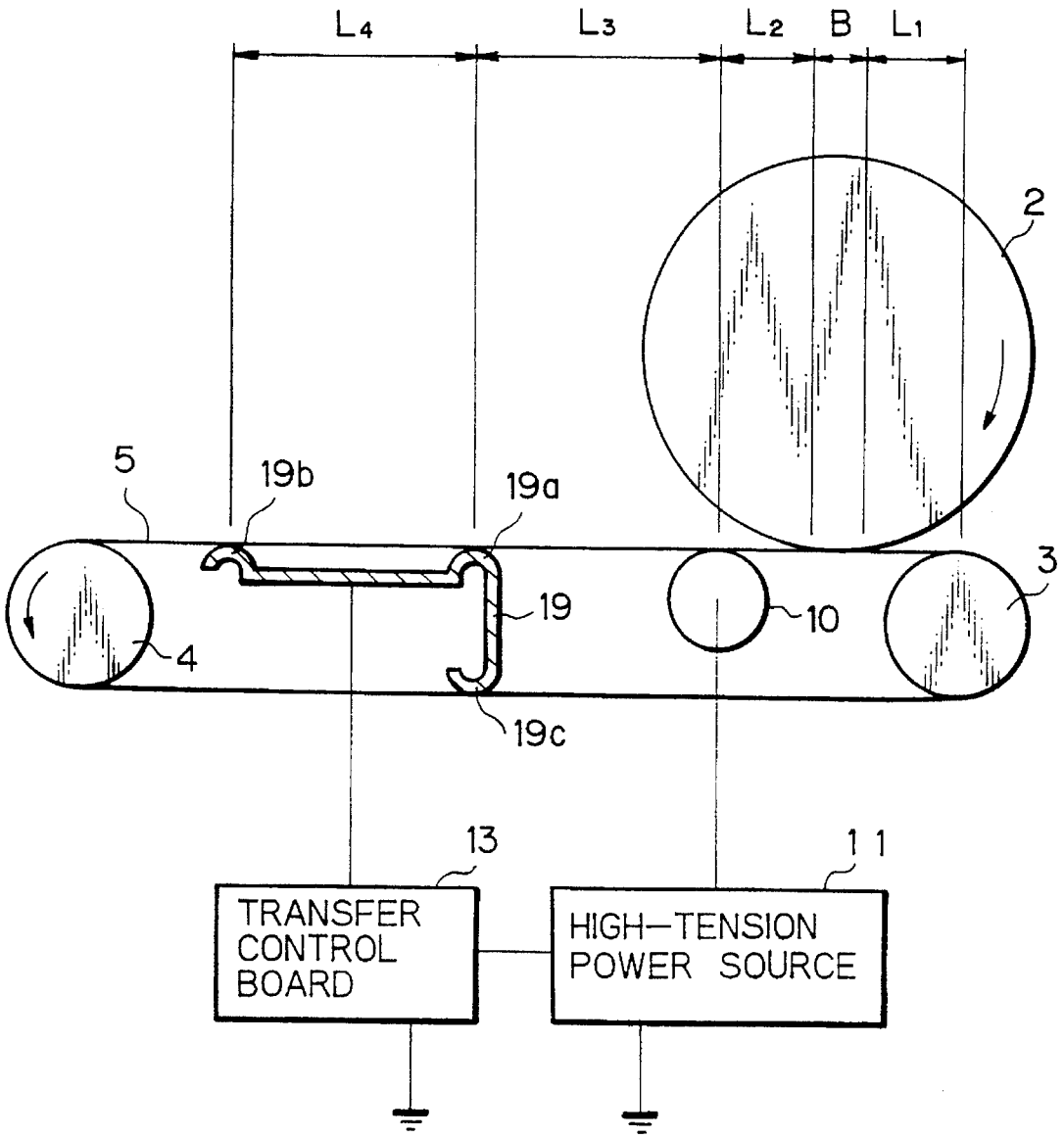
FIG. 6 shows a modified configuration of the contact plates of FIG. 5.
Figure 7:
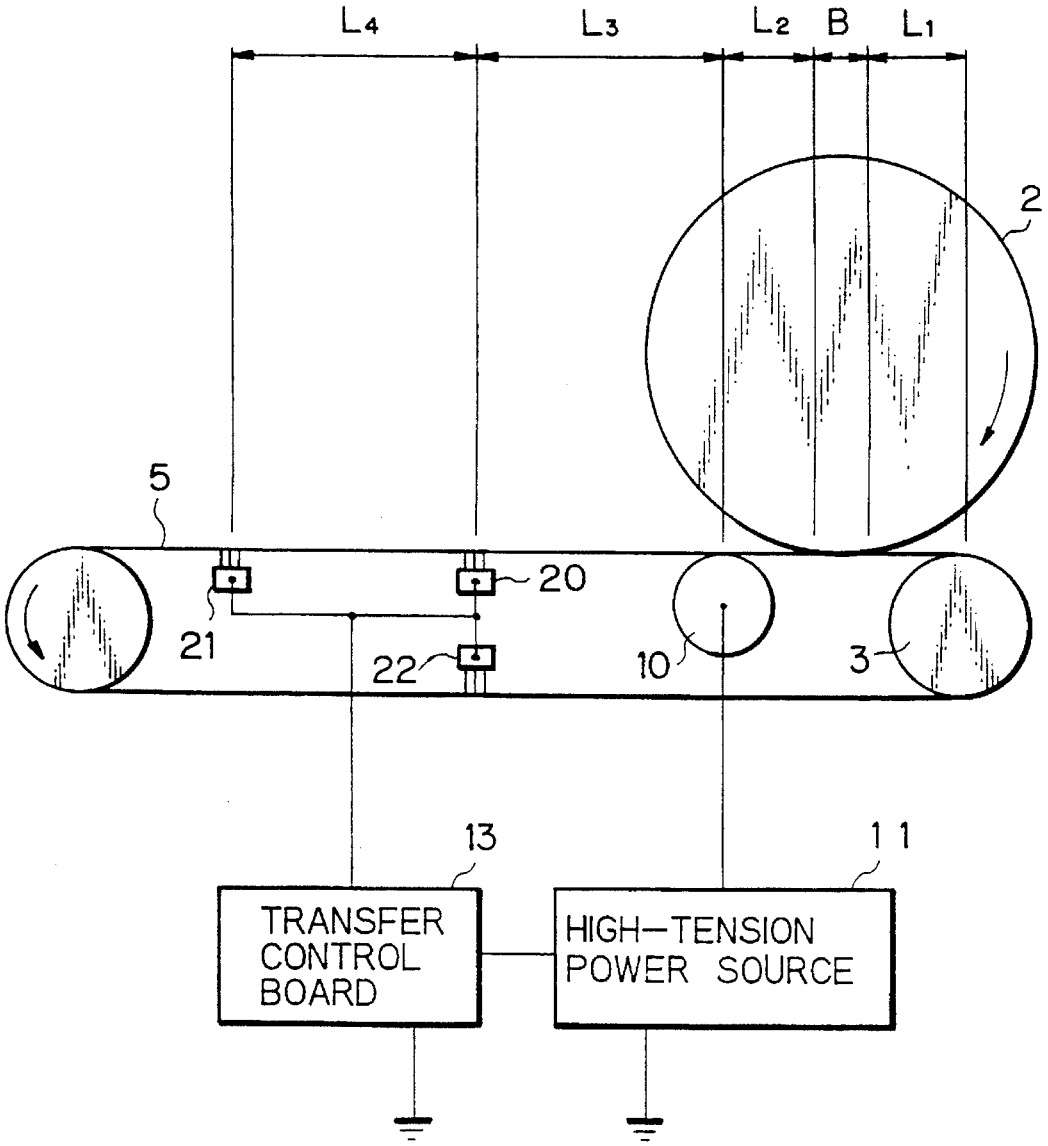
FIG. 7 shows another specific con figuration of the contact plates of FIG. 5.

As also shown in FIG. 5, a third contact plate 18 may be held in contact with the inner surface of the lower run of the belt 5 which is opposite to the upper run for carrying the sheet S. The contact plate 18 serves the same function as the other contact plates 12 and 17. As shown in FIG. 6, the contact plates 12, 17 and 18 may be implemented as a single contact member 19 formed of a sheet metal, if desired. Further, as shown in FIG. 7, the contact plates 12, 17 and 18 may be respectively constituted by conductive brushes 20, 21 and 22 in order to reduce the contact resistance.

A reference will be made to FIGS. 8–14 for describing specific arrangements for preventing the current to flow to the photoconductive element from changing due to a change in the resistance of the transfer belt, a change in the property of the sheet, etc.

Figure 8:
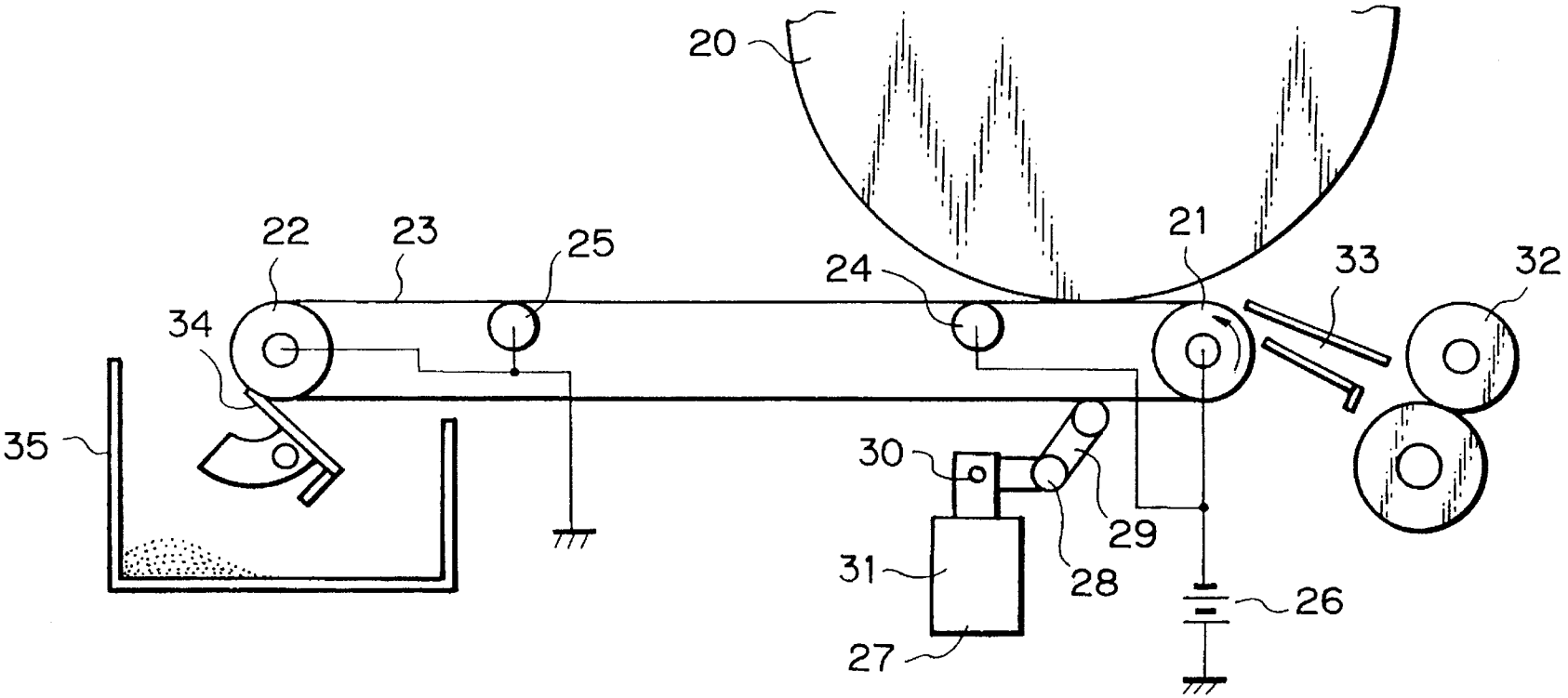
FIG. 8 shows a specific arrangement for maintaining a difference between a current to flow to the transfer belt and a current to flow to ground constant.

In FIG. 8, a photoconductive drum, or image carrier, 20 is rotatable. Arranged around the drum 20 are a discharger for discharging the drum 20, a charger for charging the drum 20, an exposing section for forming an electrostatic latent image on the drum 20 by light, a cleaning unit for cleaning the drum 20 and other conventional process units, although not shown in the figure. A transfer belt 23 is disposed below the drum 20 and passed over a conductive drive roller 21 and a conductive driven roller 22. The upper run of the belt 23 is supported by conductive rollers 24 and 25 from the rear. The drive roller 21 is connected to a motor, not shown, and rotated in a direction indicated by an arrow in the figure. The rollers 21 and 24 are connected to a power source 26 to play the role of contact electrodes contacting the belt 23. The roller or contact electrode 24 is located downstream of a nip portion between the drum 20 and the belt 23 with respect to an intended direction sheet transport. Specifically, the roller 24 is positioned such that a charge is not injected into a sheet before the sheet reaches a position where it faces the drum 20, as in the arrangement of FIG. 1. Again, this is successful in preventing a sheet from wrapping around the drum 20. The other rollers 22 and 25 are connected to ground. The belt 23 is formed of a dielectric material having a resistance of $10^6\Omega$ to $10^{12}$ Ω, particularly 9 to $9.4\times10^7$ Ω in the embodiment.

The belt 23 is selectively brought into or out of contact with the drum 20 by a mechanism 27 including a lever 29 and a solenoid 31. The lower end of the lever 29 is rotatably connected to a plunger 30 extending out from the solenoid 31. The lever 29 supports the belt 23 at the upper end thereof and is rotatable about a shaft 28. A sheet guide 33 extends from a register roller, or sheet transporting means, 32 to the drive roller 21. A cleaning blade 34 is disposed in a top-open waste toner container 35 and urged against the driven roller 22 with the intermediary of the belt 23 to remove a toner remaining on the belt 23.

Figure 9:
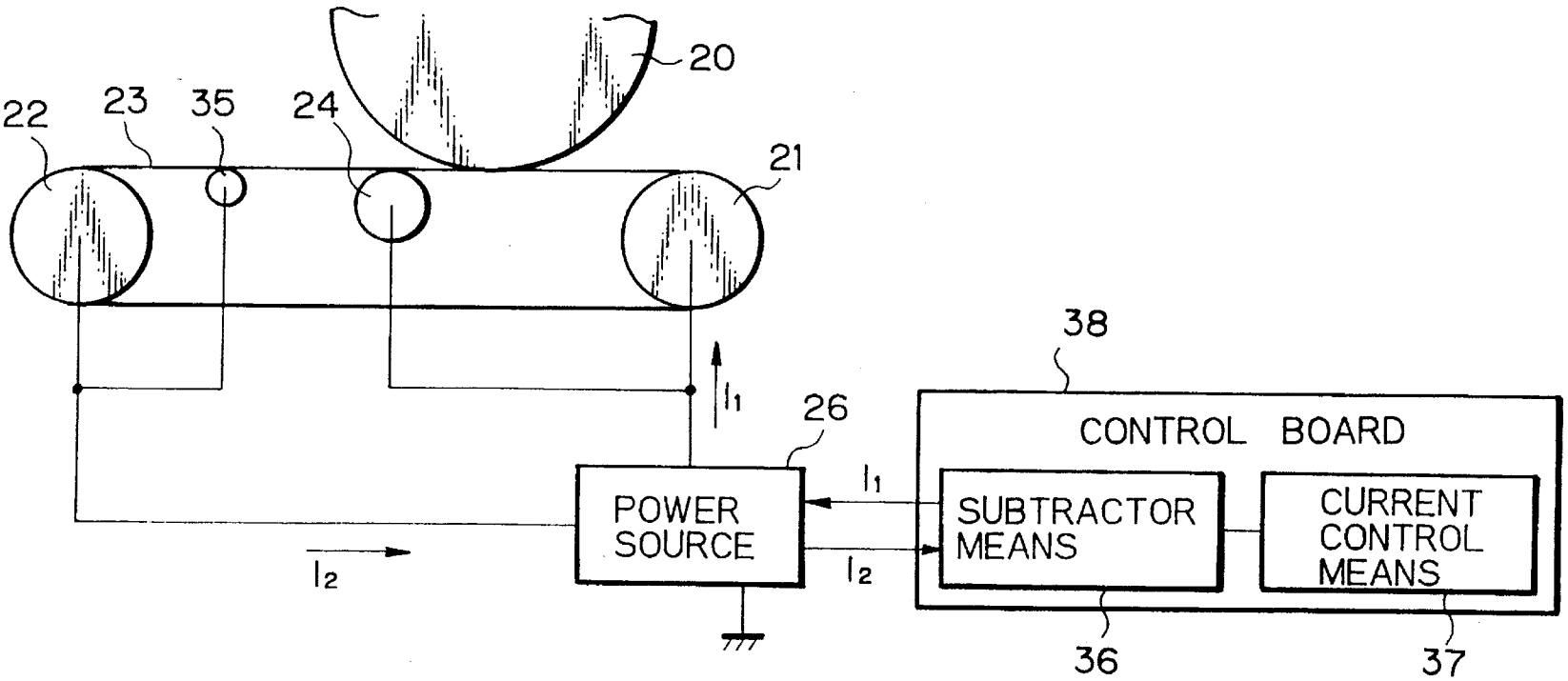
FIG. 9 is a schematic block diagram associated with FIG. 8.

As shown in FIG. 9, assume that a current $I_1$ is fed from the power source 26 to the belt 23 via the drive rollers or contact electrodes 21 and 24, and that a current $I_2$ flows from the belt 23 to ground via the rollers 22 and 25. A control board 38 includes subtractor means 36 and current control means 37. The subtractor means 36 subtracts the current $I_2$ from the current $I_1$. The controller 37 controls the current from the power source 26 to the rollers 21 and 24 such that the residual produced by the subtractor means 36 remains constant, i.e., at 30 μA in this case.

In operation, a sheet, not shown, is brought to a stop at the nip portion of the register roller 32 and then driven to between the drum 20 and the belt 23 in synchronism with the rotation of the drum 20. At this instant, the solenoid 31 is energized to cause the lever 29 to bring the belt 23 into contact with the drum 20. In FIG. 9, a current is fed from the power source 26 to the dielectric belt 23 via the rollers 21 and 24 while the belt 23 is driven by the roller 21 to transport the sheet to the left. Since the belt 23 has a resistance of 9 to $9.4\times10^7$ Ω, as stated earlier, the current is prevented from being immediately flowing to ground. Hence, a charge required for image transfer can be deposited on the belt 23 in the vicinity of the drum 20. In addition, the current control means 37 controls the current to the belt 23 such that the difference between the current $I_1$ to the belt 23 and the current $I_2$ to ground remains constant, as also stated previously. It follows that although the resistance of the belt 23 may change, the current to flow from the belt 23 to the drum 20 remains constant to in turn maintain the charge required for image transfer substantially constant between the drum 20 and the belt 23. As a result, the quality of a transferred image is enhanced.

Figure 10:
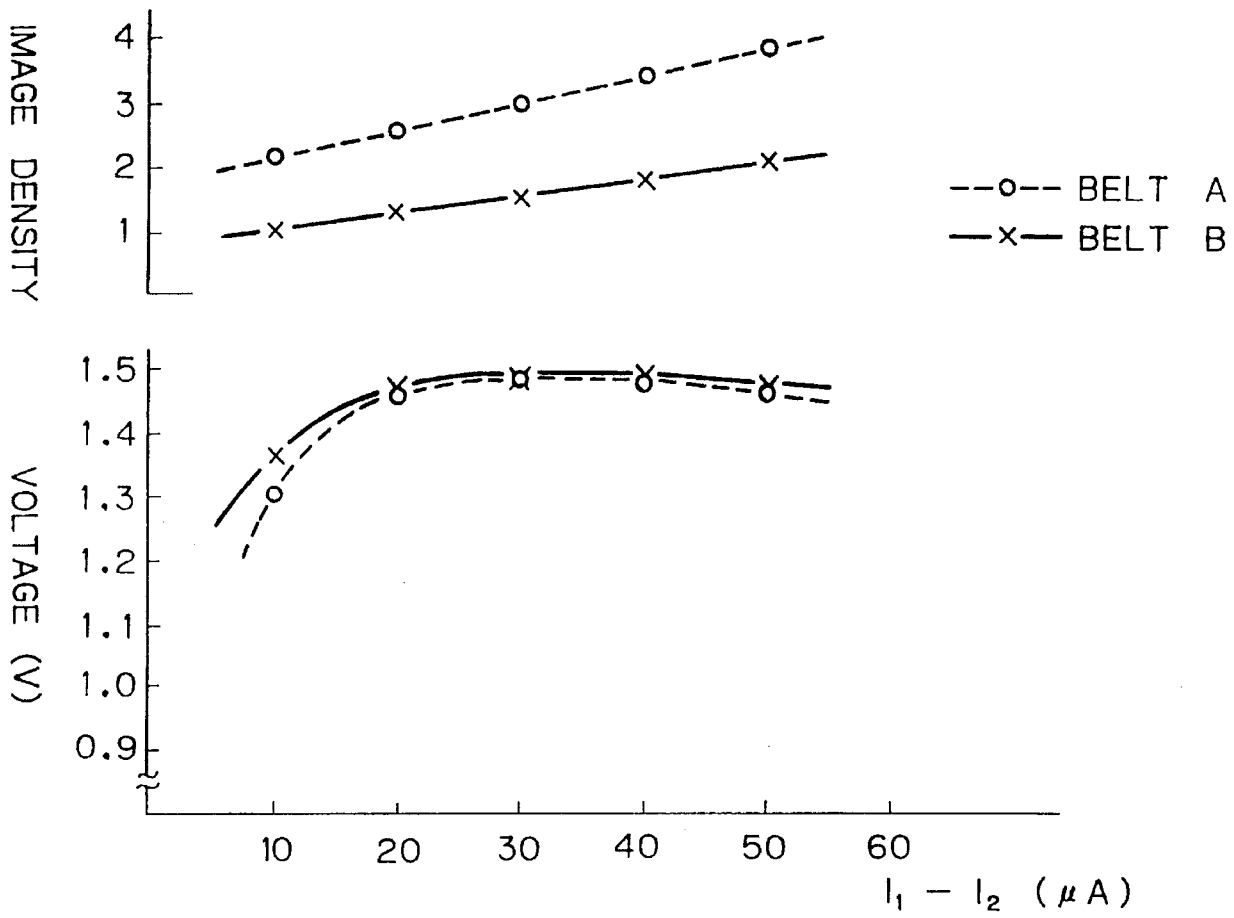
FIG. 10 plots a relation between a current and a voltage and image density with respect to different transfer belts and particular to the arrangement of FIG. 8.
Figure 11:
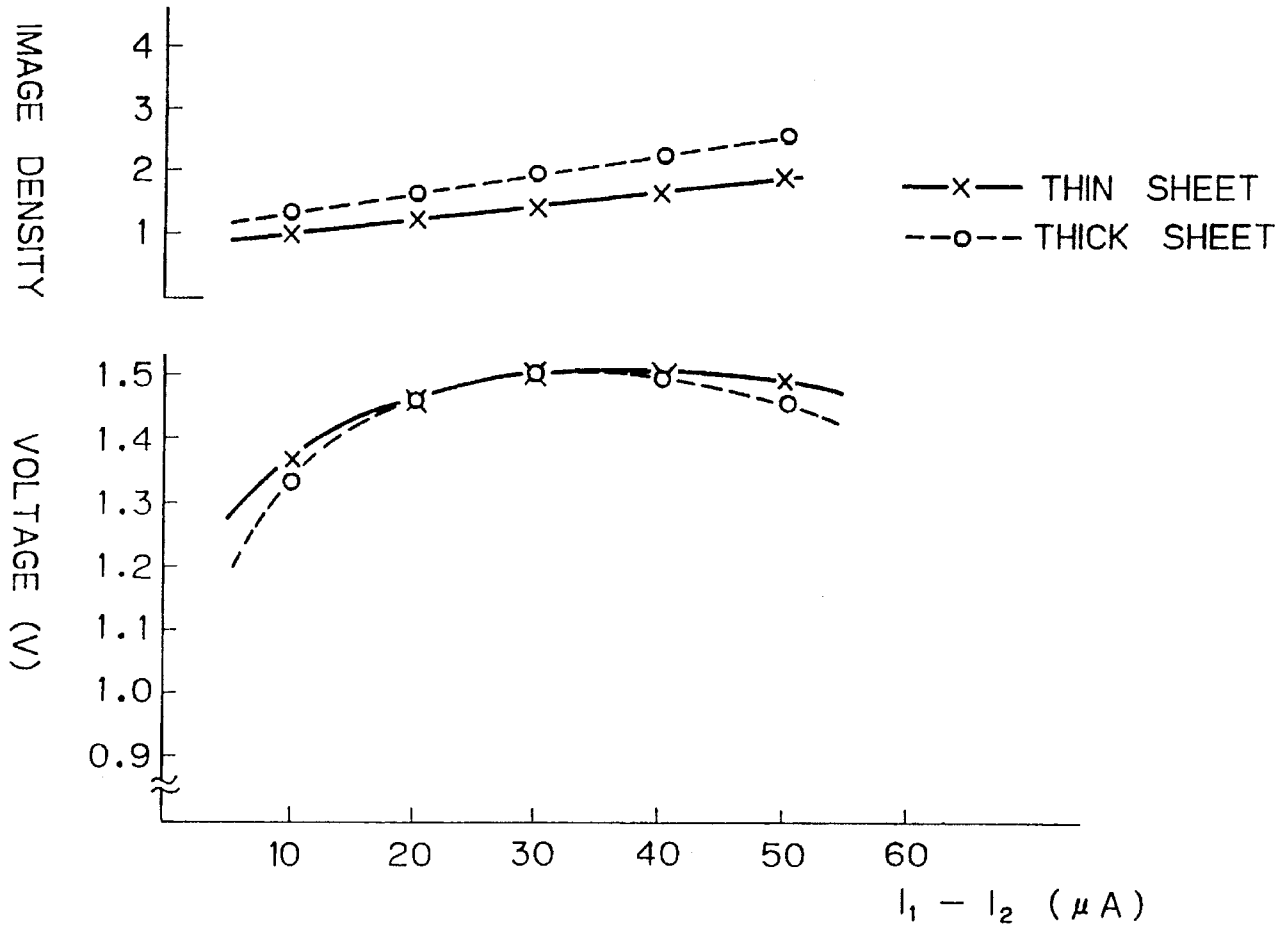
FIG. 11 plots a relation between a current and a voltage and image density with respect to different sheets and also particular to the arrangement of FIG. 8.
Figure 12:
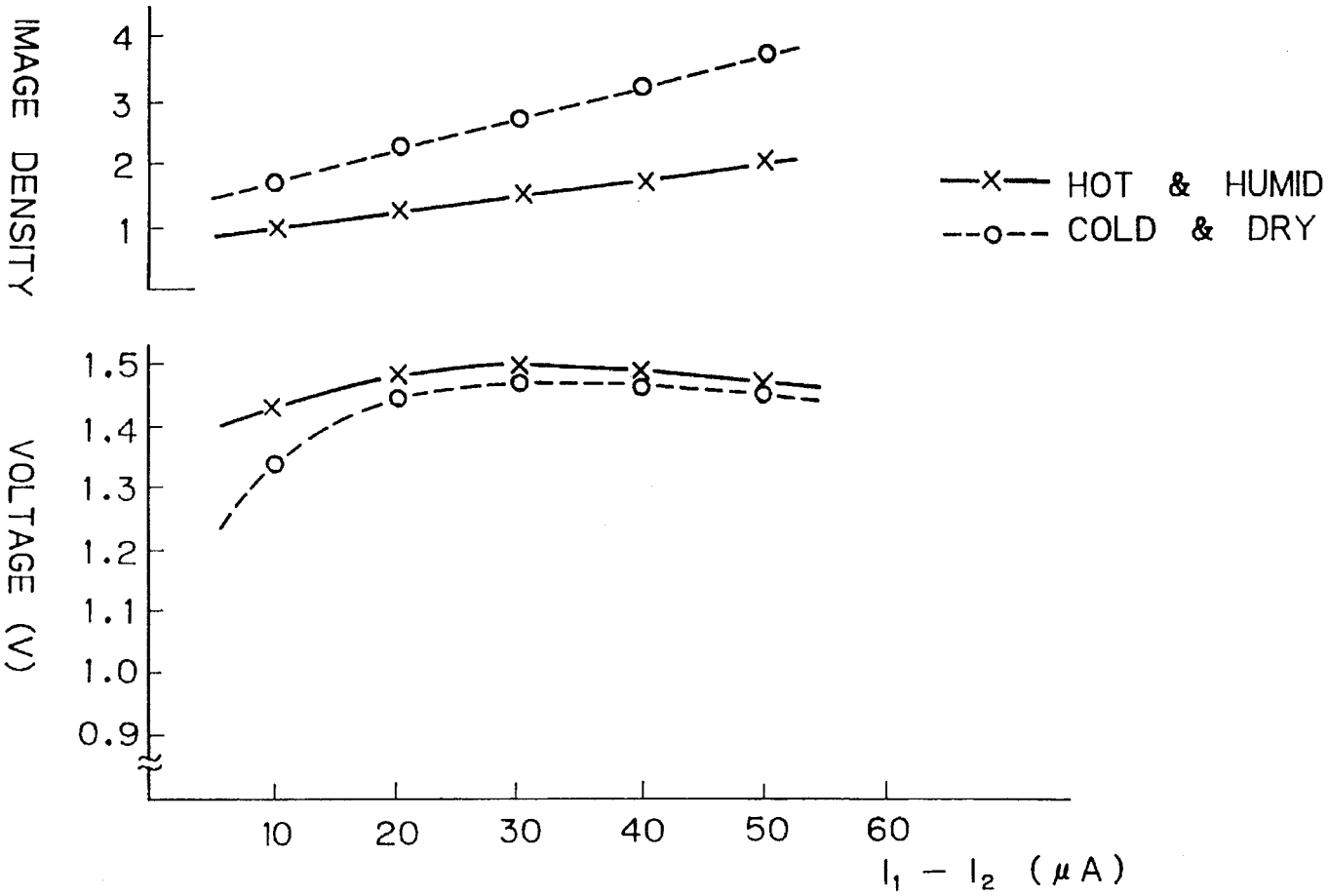
FIG. 12 plots a relation between a current and a voltage and image density with respect to different environments and also particular to the arrangement of FIG. 8.

FIGS. 10–12 show experimental data for supplementing the above description of the operation. In the figures, the abscissa and the ordinate indicate respectively the difference between the currents $I_1$ and $I_2$ and the voltage applied to the belt 23 together with image density. Specifically, in FIG. 10, dotted curves and solid curves indicate respectively data derived from belts A and B each having a particular resistance.

FIG. 11 is indicative of a relation between the difference between the currents $I_1$ and $I_2$ and the voltage and image density. Solid curves and dotted curves are respectively associated with a thin sheet and a thick sheet each having a particular conductivity characteristic.

FIG. 12 shows a relation between the difference between the currents $I_1$ and $I_2$ and the voltage and image density with respect to different environments. Solid curves and dotted curves are respectively associated with a high temperature and high humidity environment and a low temperature and low humidity environment.

The driven roller 22 is provided with a diameter as small as about 14 mm to 16 mm, as stated earlier. Hence, the sheet carrying an image transferred from the drum 20 and being transported by the belt 23 is separated from the belt 23 due to its own elasticity and then driven out to the left. The separation of the sheet from the belt 23 is further enhanced since, as the sheet moves away from the drum 20, the charge on the belt 23 is dissipated due to the conductivity of the belt 23. When the sheet moves away from the nip portion of the drum 20, the solenoid 31 is deenergized to lower the lever 29. As a result, the belt 23 is moved away from the drum 20 to protect the drum 20 from deterioration.

If desired, a particular range of voltage which the power source 27 can apply may be set, and means for detecting a change in the voltage may be provided. Then, when the voltage is brought out of the particular range, alarm means, not shown, may produce an alarm. Specifically, when a leak occurs at a location other than between the power source and the associated member or when the current fails to flow to the belt 23, the detecting means will detect such an occurrence and cause the alarm means to produce and alarm.

Figure 13:
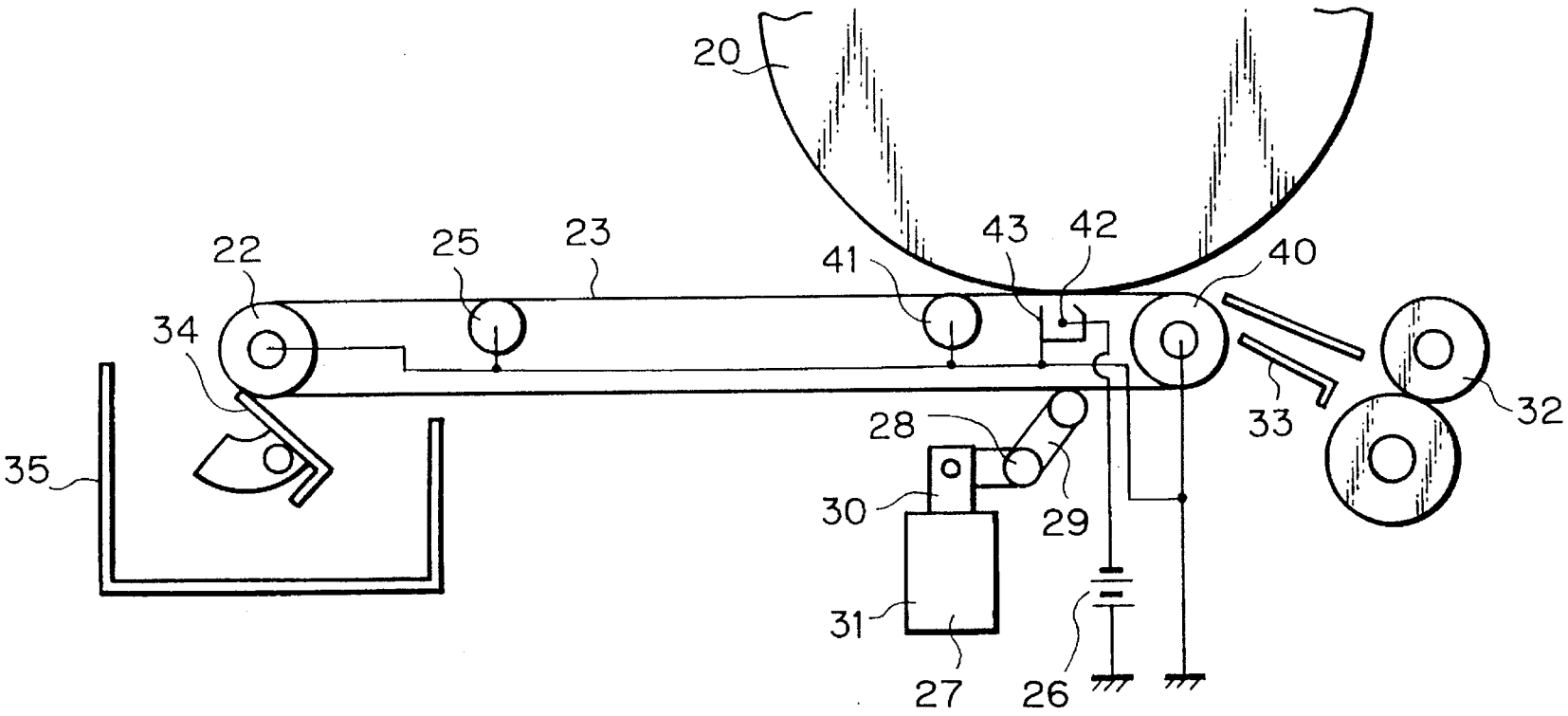
FIG. 13 is a section showing a modification of the arrangement of FIG. 8.

FIG. 13 shows a structure using a corona charger 42 for charging the belt 23. As shown, the belt 23 is driven by a driven roller 40. A roller 41 supports the belt 23 in the vicinity of the drum 20. The rollers 40 and 41 are made of a conductive material and connected to ground together with the driven roller 22 and roller 25. The corona charger 42 faces the inner surface of the belt 23 immediately below the drum 20 and has a wire and a casing 43. The wire is connected to the power source 26 while the casing 43 is connected to ground.

Figure 14:
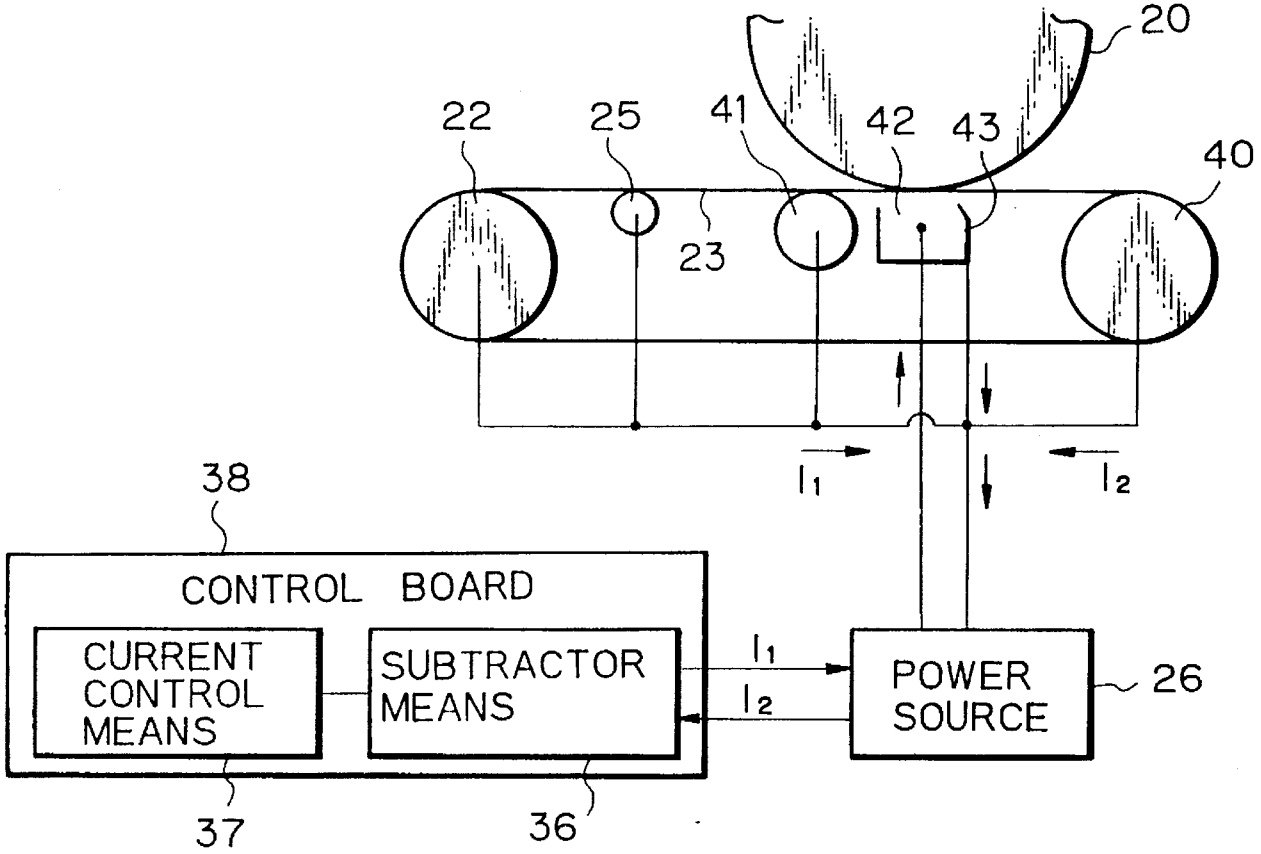
FIG. 14 is a schematic block diagram associated with FIG. 13.

As shown in FIG. 14, assume that a current $I_1$ is fed from the power source 26 to the wire of the corona charger 42, and that the sum of the current to flow from the casing 43 to ground and the current to flow from the belt 23 to ground via the rollers 22, 25, 40 and 41 is $I_2$. The control board 38 has the subtractor means 36 for subtracting 12 from $I_1$, and the current control means 37 for controlling the current from the power source 26 to the corona charger 42 such that the residual remains constant (30 μA).

In operation, as a sheet is transported by the drum 20 and belt 23, the corona charger 42 effects a discharge toward the belt 23 to deposit a charge on the belt 23. At this instant, since the belt 23 has a resistance of 9 to $9.8\times10^7$ Ω, the charge is prevented from being immediately released to ground. Hence, a charge required for image transfer can be deposited on the belt 23 in the vicinity of the drum 20. Moreover, the current control means 37 controls the current from the power source 26 to the corona charger 42 such that the difference between the current I1 flown to the wire of the charger 42 and the currents I2 to flow from the casing 43 and belt 23 to ground remains constant. It follows that although the resistance of the belt 23 may change, the charge to be deposited from the belt 23 on the drum 20 can be maintained constant to in turn maintain the charge required for image transfer substantially constant between the drum 20 and the belt 23. As a result, the quality of a transferred image is enhanced.

The operation described above is also proved by the data shown in FIGS. 10–12. In this embodiment, the voltage and current shown in FIGS. 10–12 are similarly applicable to the corona charger 32. Regarding the effects, this embodiment is substantially comparable with the previous embodiment.

Referring again to FIG. 6, the distance between the bias roller 10 and the contact plate 19 is so selected as to set up the relation $I_2 \leqq I_{OUT}$. Specifically, the contact plate 19 has two upper contact portions 19*a* and 19*b* contacting the belt 5 between the bias roller 10 and the drive roller 4, and a single lower contact portion 19*c* contacting the belt 5 between the drive roller 4 and the driven roller 3. The distance between the bias roller 10 and the contact plate 19 is determined by the ratio between the distances $L_2$ and $L_3$. FIG. 16 represents a range satisfying $I_2 \leqq I_{OUT}$ when the surface resistance of the portion of the belt 5 contacting the bias roller 10 and the ratio between $L_2$ and $L_3$ are changed. In FIG. 16, a circle, a triangle and a cross respectively indicate $I_2 < I_{OUT}$, $I_2 \approx I_{OUT}$, and $I_2 > I_{OUT}$. In the specific configuration of FIG. 6, the ratio between $L_2$ and $L_3$ is so selected as to satisfy $I_2 \leqq I_{OUT}$, thereby realizing a desirable image transfer and sheet separation ability and, therefore, an attractive image.

The local omission of an image due to the discharge at the image transfer position and the disfigurement thereof at the sheet separation position in a low humidity environment are contrary to each other with respect to the current $I_{OUT}$. As shown in FIG. 17, a relation between the local omission and the disfigurement at the respective positions was experimentally determined by converting, while the relation $I_2 \leqq I_{OUT}$ was maintained, $I_{OUT}$ into a charge density for a unit area on the basis of the linear velocity P (cm/sec) of the belt 5 and the length d (cm) of the contact electrode 10 (as measured in the widthwise direction of the belt 5). In FIG. 17, a circle, a triangle and a cross respectively represent an image free from such defects, an image slightly suffered from both of the defects, and an image noticeably suffered from them.

In light of the above, in accordance with the present invention, $I_{OUT}/(P \cdot d)$ was selected such that $2/10^8 \leqq I_{OUT}/(P \cdot d) \leqq 8/10^8$ holds. This ensures a stable image transfer and sheet separation ability at all times although the linear velocity P of the belt 5 and the length d of the contact electrode 10 may change. Further, by confining $I_{OUT}/(P \cdot d)$in a narrower range which sets up $3/10^8 \leqq I_{OUT}/(P \cdot d) \leqq 6/10^8$, the present invention achieves the above advantage despite changes in linear velocity P and length d.

In summary, the present invention provides a guide for determining a positional relation between members constituting an image transferring device as well as the materials of such members, and positions the members on the basis of the guide. Hence, when a transfer bias for setting the surface potential of a sheet is applied, there are eliminated the dielectric breakdown of a photoconductive element and that of a transfer belt and noise otherwise introduced in electric control circuitry. It follows that the transfer bias and discharge for preventing a sheet from wrapping around the photoconductive element and from being incompletely separated from the transfer belt can function effectively.

In accordance with the invention, present current control means controls a current from a power source to a contact electrode such that a current to flow from the transfer belt to the photoconductive element remains constant. Therefore, a charge required for substantial image transfer is maintained constant between the photoconductive element and the transfer belt although various factors including the environment, the property of a sheet, the resistance of the transfer belt and the area of an image may change. This enhances the quality of image transfer. Moreover, since the contact electrode used to achieve such an advantage is located at a position where a charge is not injected into a sheet before the sheet reaches tile photoconductive clement, the transfer of the true charge to the sheet is delayed to prevent the sheet from wrapping around the photoconductive element and from being incompletely separated.

The current control means controls the current from the power source to the contact electrode such that a difference between a current to the transfer belt and a current to ground remains constant. Therefore, despite that the resistance of the belt may change, a charge required for substantial image transfer is maintained constant between the photoconductive element and the transfer belt. Since a contact member is provided for detecting a current to flow to ground, it is possible to determine a current to the transfer belt and a current to ground with accuracy.

A particular range of voltage which the power source can apply may be set in order to produce an alarm when the voltage does not lie in such a range. This surely eliminates an occurrence that no current is fed to the transfer belt to render the image transfer defective.

An electrode is located at the rear of the transfer belt, or the transfer belt itself is made of a dielectric material. Hence, a current $I_{OUT}$ to flow from the contact electrode to ground via the nip portion between the belt and the image carrier and the image carrier is maintained greater than or equal to a current $I_2$ to flow from the contact electrode to ground via the belt without the intermediary of the nip portion. Consequently, a desirable image transfer and sheet separation ability and, therefore, attractive images are achievable.

Current control means for maintaining the current $I_{OUT}$ constant is provided. This not only obviates the local omission of an image at an image transfer position due to discharge and the disfigurement of the same in the event of sheet separation, but also implements a stable image transfer and sheet separation ability, thereby producing desirable images.

In addition, assuming that the linear velocity of the transfer belt and the length of the contact electrode are respectively P (cm/sec) and d (cm), $I_{OUT}$ is so selected as to satisfy a relation $2/10^8 \leqq I_{OUT}/(P \cdot d) \leqq 8/10^8$. It follows that the desirable image transfer and sheet separation ability is ensured although the linear velocity of the belt and the length of the contact electrode may change.

Various modifications will become possible for those skilled in the art after receiving the teachings of the present disclosure without departing from the scope thereof.

What is claimed is:

1. A device for transferring an image formed on an image carrier to a sheet and then separating said sheet from said image carrier, said device comprising:

a transfer belt movable into contact with an outer periphery of the image carrier;

drive means for causing said transfer belt to rotate;

a contact electrode held in direct contact with said transfer belt; and charge applying means for applying a charge to said transfer belt via said contact electrode;

wherein a current flow $I_{OUT}$ from said contact electrode to ground via a nip portion between said transfer belt and said image carrier is maintained greater than or equal to a current flow $I_2$ from said contact electrode to ground via said transfer belt without the intermediary of said nip portion.

2. A device as claimed in claim 1, further comprising current control means for maintaining said current $I_{OUT}$ constant.

3. A device as claimed in claim 1, wherein assuming that a linear velocity of said transfer belt and a length of said contact electrode are respectively P (cm/sec) and d(cm), said current $I_{OUT}$ is so selected as to satisfy a relation $2/10^8 \leqq I_{OUT}/(P \cdot d) \leqq 8/10^8$.

4. A device as claimed in claim 1, wherein said transfer belt includes a front surface which carries a sheet, said transfer belt further including a rear surface, and wherein said contact electrode contacts the rear surface of said transfer belt and said contact electrode is disposed at a location such that said current $I_{OUT}$ is greater than or equal to said current $I_2$.

5. A device as claimed in claim 1, the dielectric material constituting said transfer belt has a resistance which renders said current $I_{OUT}$ greater than or equal to said current $I_2$.

6. A device as claimed in claim 1, further including discharge means, said discharge means including at least one discharge member disposed downstream of said contact electrode, wherein said discharge means is connected to ground, and $I_2$ flows through said discharge means.

7. A device as claimed in claim 7, wherein said at least one discharge member is between said contact electrode and a support roller downstream of the nip portion.

* * * * *